US012458059B2

(12) United States Patent
Newman et al.

(10) Patent No.: US 12,458,059 B2
(45) **Date of Patent: *Nov. 4, 2025**

(54) MODULAR CIGAR

(71) Applicant: Brothers Broadleaf LLC, Tampa, FL (US)

(72) Inventors: Robert Paxton Newman, Tampa, FL (US); Charles Dawson Newman, Tampa, FL (US)

(73) Assignee: Brothers Broadleaf LLC, Tampa, FL (US)

( * ) Notice: Subject to any disclaimer, the term of this patent is extended or adjusted under 35 U.S.C. 154(b) by 244 days.

This patent is subject to a terminal disclaimer.

(21) Appl. No.: 18/204,998

(22) Filed: Jun. 2, 2023

(65) Prior Publication Data

US 2023/0301342 A1 Sep. 28, 2023

Related U.S. Application Data

(63) Continuation-in-part of application No. 17/237,528, filed on Apr. 22, 2021, now Pat. No. 11,700,878.

(51) Int. Cl.
*A24D 1/02* (2006.01)
*A24C 1/26* (2006.01)

(52) U.S. Cl.
CPC . *A24D 1/02* (2013.01); *A24C 1/26* (2013.01)

(58) Field of Classification Search
CPC ..... A24D 1/02; A24C 1/32; A24C 1/26
USPC ..... 131/365
See application file for complete search history.

(56) References Cited

U.S. PATENT DOCUMENTS

| | | | | |
|---|---|---|---|---|
| 829,296 | A * | 8/1906 | Rosales | A24D 1/042 131/361 |
| 8,056,566 | B2 | 11/2011 | Kang et al. | |
| 8,464,727 | B1 | 6/2013 | Sinclair, Jr. | |
| 10,226,069 | B1 | 3/2019 | Sinclair, Jr. | |
| 2003/0217757 | A1 | 11/2003 | Edelmann | |
| 2005/0121341 | A1 | 6/2005 | Darwish | |
| 2011/0094525 | A1 | 4/2011 | Maal | |
| 2014/0360519 | A1 | 12/2014 | George et al. | |
| 2020/0337365 | A1 | 10/2020 | Mendoza et al. | |

* cited by examiner

*Primary Examiner* — Philip Y Louie
*Assistant Examiner* — Ronnie Kirby Jordan
(74) *Attorney, Agent, or Firm* — Barnes & Thornburg LLP

(57) ABSTRACT

A modular cigar and methods are provided for assembling and use of the modular cigar. The modular cigar includes an inner bound module and removable outer wrapper. The removable outer wrapper is coupled with the inner bound module in an adhesive-free manner.

10 Claims, 6 Drawing Sheets

MODULAR CIGAR

CROSS REFERENCE TO RELATED APPLICATIONS

This patent application is a Continuation-in-Part of U.S. patent application Ser. No. 17/237,528 filed Apr. 22, 2021, the disclosure of which is being incorporated herein by reference in its entirety.

BACKGROUND

The present disclosure relates to systems, components, and methodologies for making and using a cigar. In particular, the present disclosure relates to systems, components, and methodologies for making and using a modular cigar.

SUMMARY

According to the present disclosure, a modular cigar is provided that uses no adhesive in assembly of an inner bound module with an outer wrapper and removable cap.

In accordance with at least one embodiment, the modular cigar includes a removable end cap, an inner bound module including a filler, and a outer wrapper leaf with a main vein extending longitudinally along a length of the wrapper leaf, wherein in the rolled position coupled to the inner bound module, the main vein extends in parallel to a longitudinal axis of the modular cigar to form an adhesive-free coupling to the inner bound module In accordance with some embodiments, the outer binder leaf is formed as a parallelogram, and the longitudinally extending main vein intersects only two ends of the parallelogram transverse to the length of the wrapper leaf. The outer binder leaf may be unrolled from the inner bound module and rolled around a different inner bound module. In some embodiments a removable end cap is coupled to one end of the modular cigar around the outer wrapper to maintain the outer wrapper means securely in the rolled position around the inner bound module.

In some embodiments a modular cigar may comprise an inner bound module including a filler, the filler comprising loose or full leaf filler; and an outer wrapper means for repeatedly coupling and decoupling with the outside of the inner bound module by unrolling and rerolling, which is biased to a rolled position, so that the outer wrapper means creates an adhesive-free coupling with the inner filler module. The outer wrapper means may comprise a wrapper leaf with a main vein extending longitudinally along a length of the wrapper leaf, wherein in the rolled position coupled to the inner bound module, the main vein extends in parallel to a longitudinal axis of the modular cigar.

Additional features of the present disclosure will become apparent to those skilled in the art upon consideration of illustrative embodiments exemplifying the best mode of carrying out the disclosure as presently perceived.

BRIEF DESCRIPTION OF THE FIGURES

The detailed description particularly refers to the accompanying figures in which.

DETAILED DESCRIPTION OF THE FIGURES

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Figure 1:
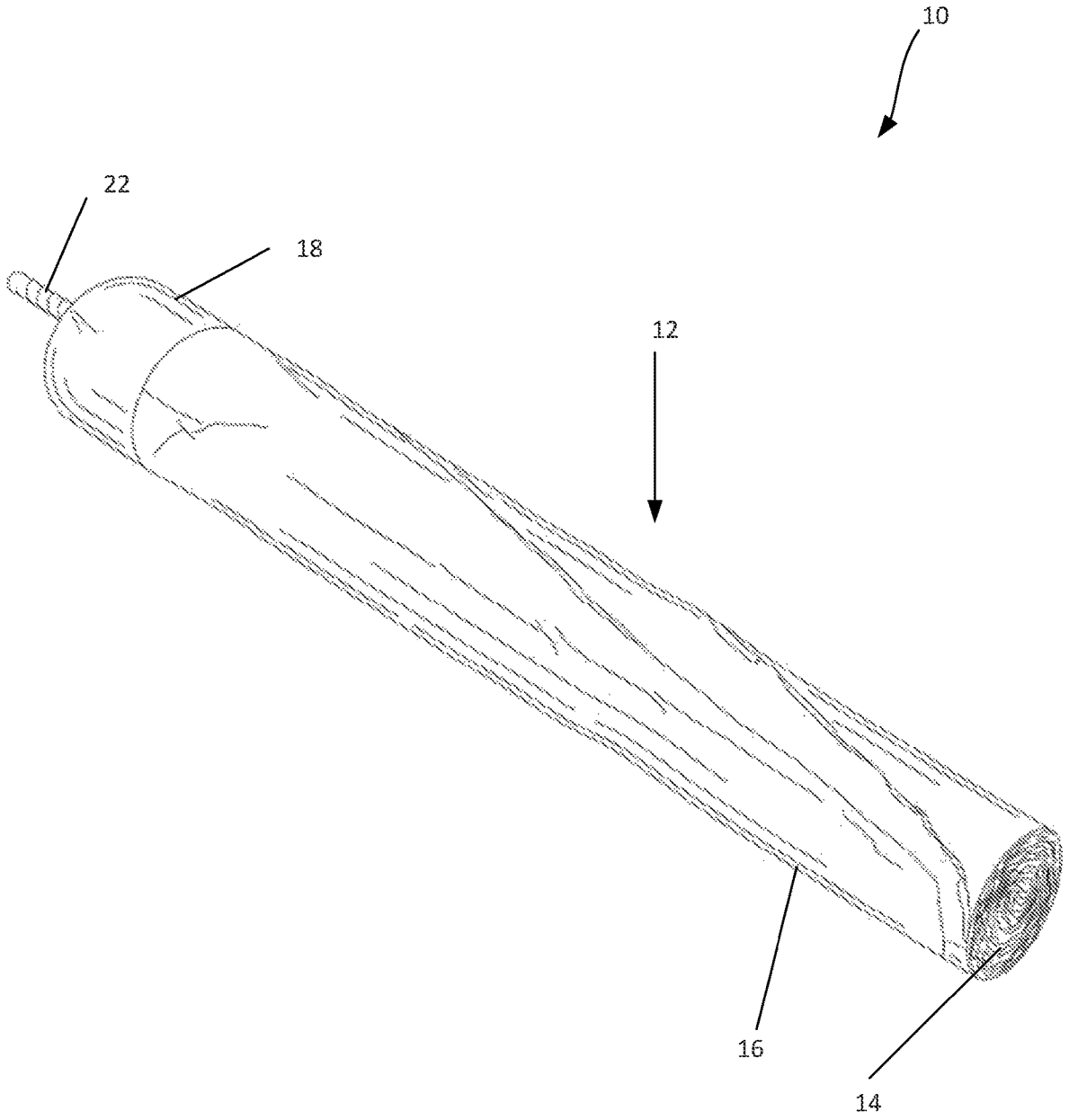
FIG. 1 is a perspective view illustrating an assembled modular cigar according to a disclosed embodiment.

FIG. 1 illustrates a modular cigar, in particular a modular cigar 10 including a cigar body 12 formed by an inner bound module 14, and an outer wrapper 16 surrounding the inner bound module 14. One end of the cigar body may include a removable end cap 18. According to FIG. 1, the inner bound module 14 includes a filler 20. The removable end cap 18 has a narrow distal end 22 formed by twisting the cap material, which may be grasped to remove end cap 18 from the cigar body 12.

Figure 2:
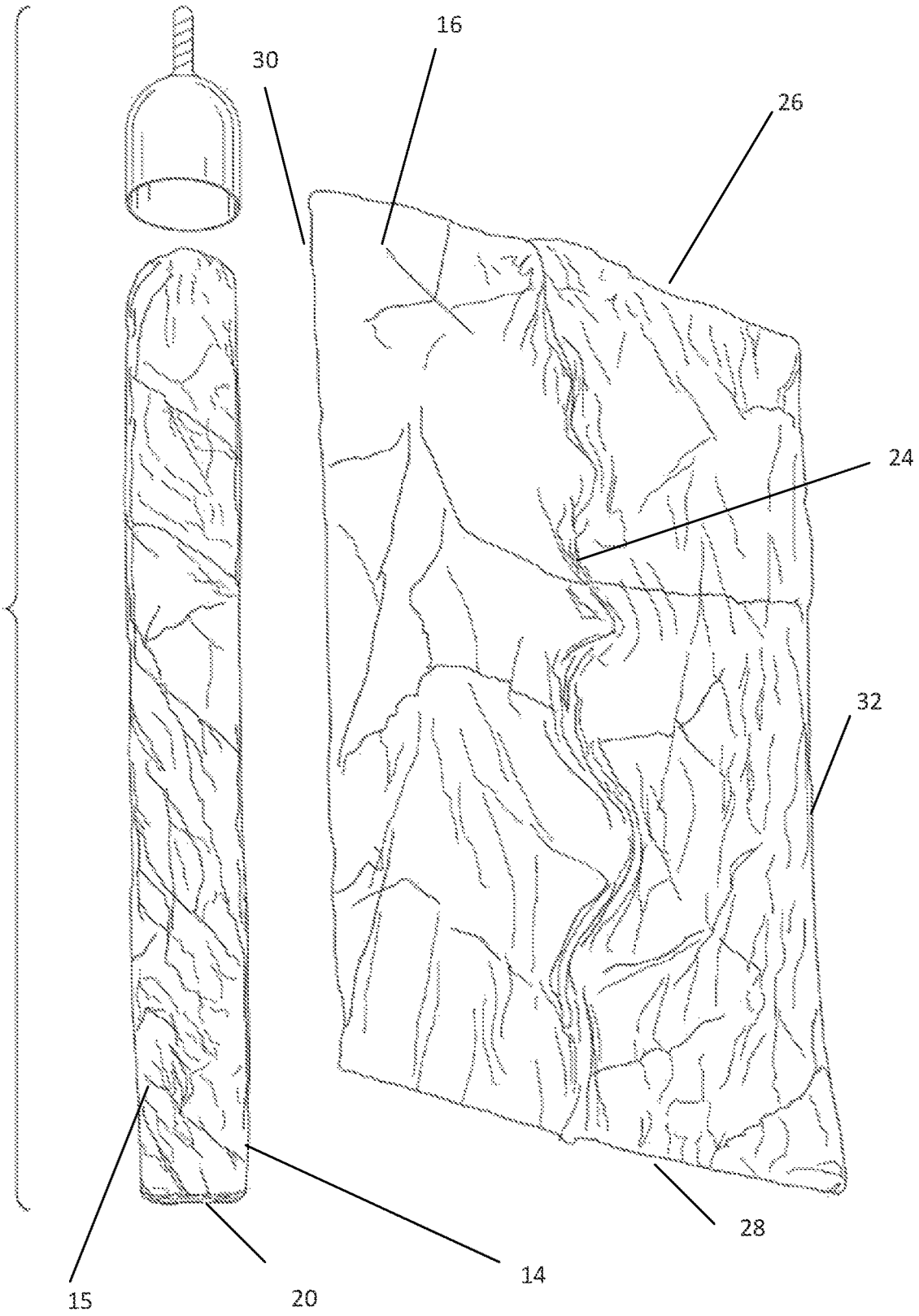
FIG. 2 illustrates the components that form the modular cigar in accordance with the disclosed embodiment of FIG. 1.
Figure 5:
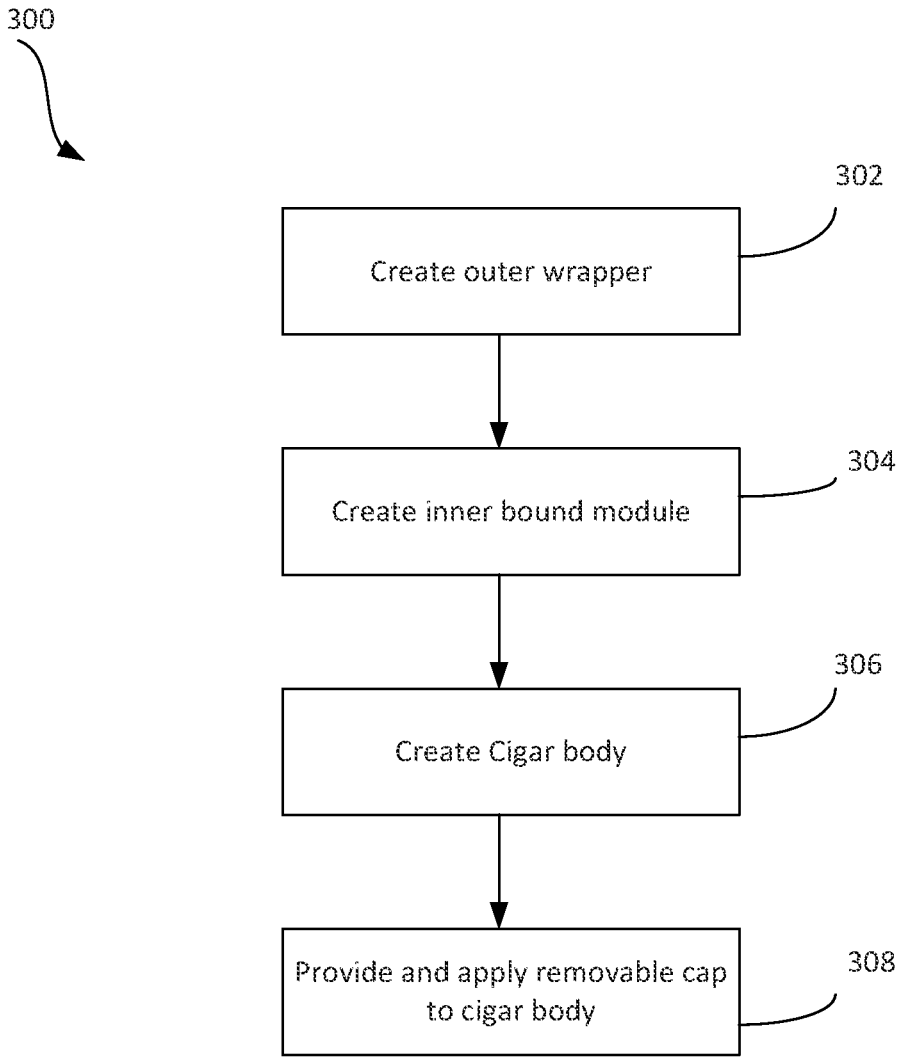
FIG. 5 is a diagrammatic flow chart of a method of assembling a modular cigar in accordance with the disclosed embodiments.

As illustrated in FIG. 2, the outer wrapper 16 is removably coupled to the inner bound module 14. When the outer wrapper 16 is decoupled from the inner bound module 14, the inner bound module 14 remains intact via a binder 15 that contains the filler 20. Outer wrapper 16 is formed from a leaf and includes a longitudinally extending main vein 24. The leaf is cut so that outer wrapper 16 is in the form of a parallelogram as illustrated, with the main vein 24 extending the length of the outer wrapper 16. The leaf may be cut to form a parallelogram having relatively longer longitudinally extending sides 30, 32 intersecting relatively shorter ends 26, 28 transverse to the main length of the outer wrapper. The leaf is cut so that the main vein 24 does not intersect either of the longitudinal sides 30, 32 of the outer wrapper 16, thereby rendering the outer wrapper 16 predisposed to curl in on itself with longitudinally sides 30, 32 curling in towards each other. In this manner, the outer wrapper 16 is predisposed to curling in the direction that it is rolled around the inner bound module 14 and biased towards the rolled position. Therefore, as illustrated in FIG. 2 and further discussed with respect to FIG. 5, the outer wrapper 16 may be secured, removed, and re-secured to inner bound module 14 or even another different inner bound module without the use of any adhesive.

Figure 3:
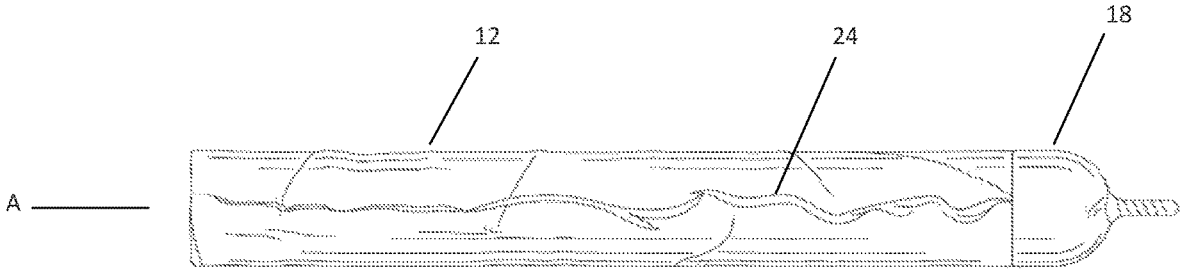
FIG. 3 is a side view of the assembled modular cigar according to the disclosed embodiment.
Figure 4:
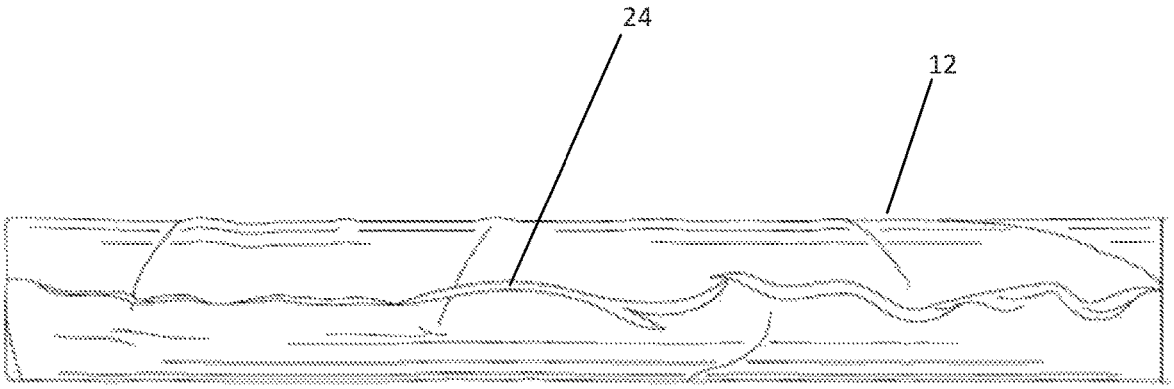
FIG. 4 is a view of the assembled modular cigar in the use configuration according to the disclosed embodiment.

FIG. 3 illustrates the assembled modular cigar with the main vein 24 extending longitudinally along the cigar body 12 and parallel to a central axis-A of the cigar body. FIG. 4 shows the cigar body 12 with the end cap 18 of FIGS. 1-2 removed. The end cap 18 may be removed by a pulling and/or twisting motion. Additionally, the endcap 18, may be moistened to facilitate removal and reuse. In this illustrated configuration, the modular cigar is ready to be smoked, or for the outer wrapper 16 to be decoupled from the inner bound module 14 by unrolling the outer wrapper 16 without damage to either the outer wrapper 16 or the inner bound module 14 due to the adhesive-less coupling. Outer wrapper 16, may be rolled around another inner bound module (not shown) to form a new cigar body. End cap 18, may be untwisted to form a flat sheet and used to repair, patch, or enhance outer wrapper 16 when rolling around another inner bound module.

Figure 6:
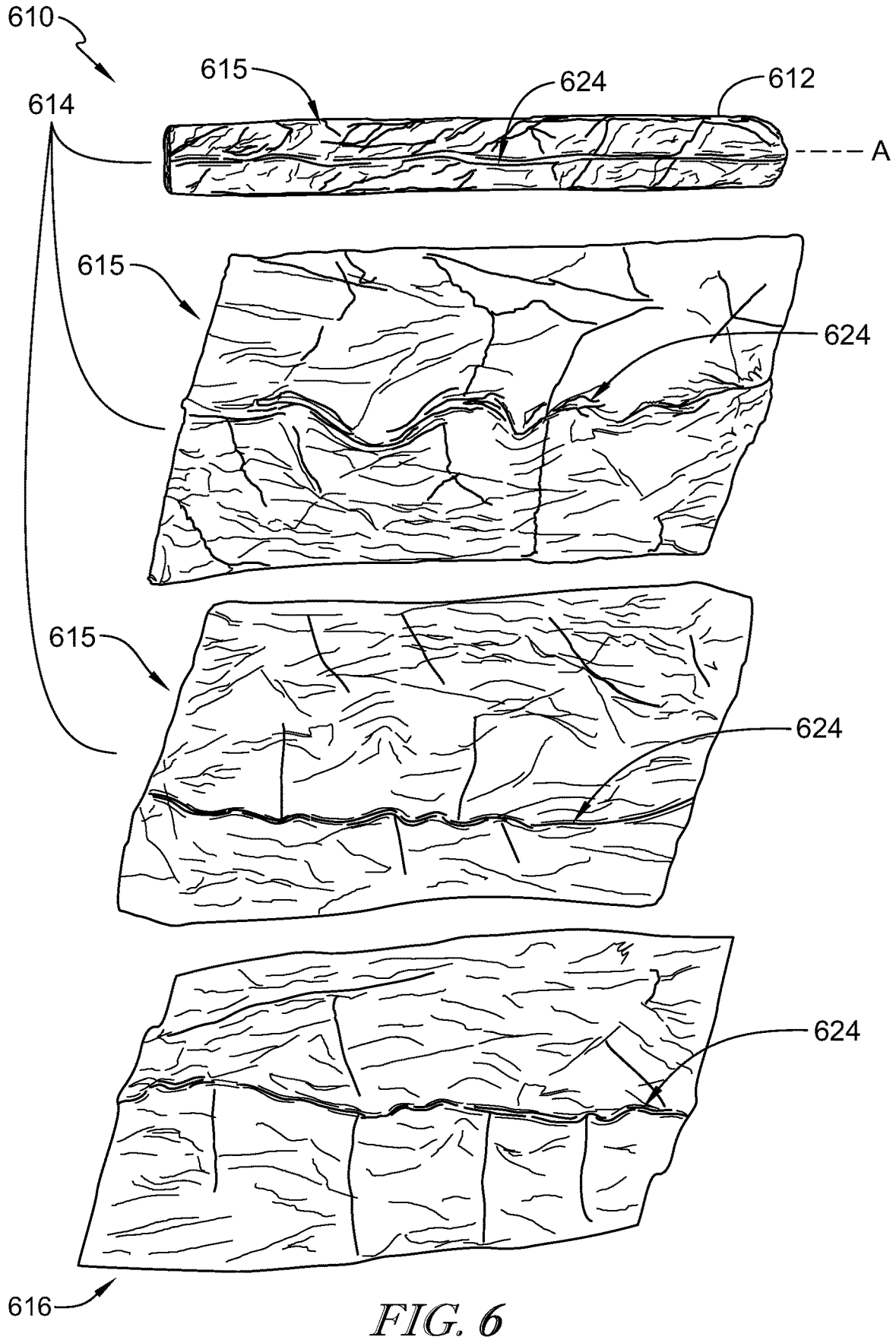
FIG. 6 is a partially exploded view of a modular cigar.

As illustrated in FIG. 6, a modular cigar 610 may alternatively have long filler 620. Outer wrapper 616 may surround a plurality of long filler leaves 615, for example binder leaves as in FIG. 1, that form the inner module 614. In this each of the outer wrapper 616 and long filler leaves 615 all have main vein 624 extending longitudinally along cigar body 612 and parallel to central axis-A of cigar body when assembled. In some embodiments, the cigar may be smoked as fully assembled. Alternatively, each of outer wrapper 616, and all long filler leaves 615 forming inner bound module are configured to decouple from each other without damage to either the wrapper 616 or one or more of the filler leaves 615 that are unwrapped or decoupled from the cigar body 612. Each leaf of the plurality of long filler leaves is configured to decouple from the outside of an adjacent leaf while the adjacent leaf remains intact with the inner bound module. Outer wrapper and/or other unwrapped filler leaves 615 may be rolled around other inner bound modules or used to roll a new cigar. Although illustrated with at least three filler leaves, cigar body may have any number of filler leaves, including as few as one.

In a method of making the modular cigar 300 as disclosed in the above embodiments, an outer wrapper is created for the cigar 302. This outer wrapper is formed from a single leaf with a main vein. The leaf may be aged for 8 months to darken and thicken the leaf. The leaf may be selected from relatively thick leaves such as a Connecticut Broadleaf or an Ecuadorian Havana. The leaf is cut so that the main vein extends longitudinally along the length of the cut outer wrapper. The outer wrapper is cut to form parallelogram to bias the longitudinally extending sides of the wrapper to curl or curve towards each other while the main vein intersects only the transverse shorter ends of the parallelogram. By using a single leaf, this curling bias can be leveraged to roll the cigar and avoid the use of adhesive. The outer wrapper may be cut by hand and/or be cut using a stencil to form the parallelogram.

An inner bound module is created for the cigar 304 so that the filler that is formed of the smokeable component is contained. The smokeable component may be any loose smokeable filler including but not limited to tobacco. Alternatively, the smokeable component may be long filler, including tobacco leaves. The binder may be selected from any tobacco leaves, which is relatively thinner compared to the outer wrapper leaf. The binder may bind the loose filler by being rolled to surround the loose filler. The binder leaf may be sealed around the loose filler using an adhesive to provide a mess-free inner bound module. For example, a Lieberman tool may be used to roll the wrapper around the filler. In some embodiments the long filler comprises a plurality of binder leaves, i.e. a plurality of tobacco leaves that may, in some embodiments, be thinner than the outer wrapper leaf. In some embodiments the plurality of tobacco leaves may be thicker than, the same thickness as, or vary in thickness relative the outer wrapper leaf. Therefore, the inner bound module may be created by wrapping each of the leaves around each other, with each leaf cut so that the main vein extends longitudinally along the length of the cut long filler leaf. Similar to the outer wrapper, the long filler leaves may be cut to form parallelogram to bias the longitudinally extending sides of the wrapper to curl or curve towards each other while the main vein intersects only the transverse shorter ends of the parallelogram. In some embodiments the filler leaves are coupled to form the inner module via adhesive-less coupling. For example, the filler leaves may be joined by moistening each of the filler layers to make them pliable to roll each leaf layer around the next leaf layer and then drying, for example in a mold, to maintain the cylindrical shape. Drying may occur sequentially after each leaf is added or after all the filler leaves have been wrapped.

A cigar body is created 306 by coupling the outer wrapper to the inner bound module. This may be done by moistening the wrapper to make it pliable and rolling the wrapper around the inner bound component, for example, by hand. Once the wrapper has been rolled around the inner bound component, the rolled body may be placed in a cigar mold, having a cylindrical shape to match the shape of the cigar body so that the wrapper rolled around the inner bound component will dry to and maintain a consistent cylindrical shape without the use of any adhesives. The cigar body may be placed in the mold so that one end of the cigar body extends outside of the mold. The length of the cigar extending outside the mold is less than 1.5 inches.

A removable cap is provided in some embodiments and applied to the dried stiffened cigar body 308. The cap may be applied by rolling a cap leaf around end of the cigar exposed outside the mold and then twisting the free end of the cap leaf not touching the cigar body to enclose the end of the cap. The cap can be made from a leaf such as a Connecticut shade tobacco leaf. The fully assembled modular cigar may then be removed from the mold 310.

Although the disclosed modular cigar includes the removable endcap, it is also possible that other endcaps or bands may be used to maintain the integrity of the assembled cigar during packaging and transit. Alternatively, the modular cigar may be assembled without an endcap or band using adhesive, or without adhesive by using any combination of water, heat and/or pressure to form a seal that allows for unrolling and re-rolling. Further, it is possible that the particularly cut outer wrappers can be packaged decoupled from and/or along with a plurality of inner bound components as a kit to permit assembly of the cigar body by the consumer by rolling the biased outer wrappers.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

The invention claimed is:

1. A modular cigar comprising:

an inner bound module including a filler, the filler comprising loose or full leaf filler; and an outer wrapper means for repeatedly coupling and decoupling with the outside of the inner bound module by unrolling and rerolling, which is biased to a rolled position, so that the outer wrapper means creates an adhesive-free coupling with the inner filler module, wherein the outer wrapper means comprises a wrapper leaf with a main vein extending longitudinally along a length of the wrapper leaf, wherein in the rolled position coupled to the inner bound module, the main vein extends in parallel to a longitudinal axis of the modular cigar.

2. The modular cigar of claim 1, wherein the wrapper leaf is formed in a parallelogram shape, wherein the longitudinally extending main vein intersects only two ends of the parallelogram transverse to the length of the wrapper leaf.

3. The modular cigar of claim 1, wherein the wrapper leaf is configured to decouple from the outside of the inner bound module, while the inner bound module remains intact.

4. The modular cigar of claim 1, wherein the inner bound module is long filler formed from a plurality of leaves, wherein each leaf is rolled around the outside of another leaf.

5. The modular cigar of claim 4, wherein each leaf of the plurality of long filler leaves is configured to decouple from the outside of an adjacent leaf while the adjacent leaf remains intact with the inner bound module.

6. The modular cigar of claim 1, wherein the inner bound module is long filler formed from a plurality of leaves, wherein each leaf has a main vein extending longitudinally along a length of the leaf, wherein in the rolled position the main vein extends in parallel to a longitudinal axis of the modular cigar.

7. The modular cigar of claim 6, wherein two longitudinal sides of each leaf free of intersection of the longitudinally extending main vein curve inwardly towards each other in a decoupled, non-stressed position.

8. The modular cigar of claim 1, wherein two longitudinal sides of the wrapper leaf free of intersection of the longitudinally extending main vein curve inwardly towards each other in a decoupled, non-stressed position.

9. The modular cigar of claim 1, comprising a removable end cap configured to be coupled to one end of the modular cigar around the outer wrapper means to maintain the outer wrapper means in the rolled position around the inner bound module.

10. The modular cigar of claim 1, wherein the filler is full leaf filler, and the inner bound module is formed via adhesive-free coupling of full leaves.

* * * * *